US006267461B1

(12) United States Patent
Dunagan et al.

(10) Patent No.: US 6,267,461 B1
(45) Date of Patent: Jul. 31, 2001

(54) SPORT BALL STORAGE APPARATUS AND METHOD FOR STORING AND DISPENSING A SPORT BALL

(76) Inventors: James L. Dunagan; Janice C. Dunagan, both of 17 McConnell Manor Rd., Trenton, TN (US) 38382

( * ) Notice: Subject to any disclaimer, the term of this patent is extended or adjusted under 35 U.S.C. 154(b) by 0 days.

(21) Appl. No.: 09/338,807

(22) Filed: Jun. 23, 1999

Related U.S. Application Data

(60) Provisional application No. 60/090,286, filed on Jun. 23, 1998.

(51) Int. Cl.[7] ..... A47F 1/08

(52) U.S. Cl. ..... 312/49; 312/245; 312/290; 220/475; 220/345.1; 232/43.1

(58) Field of Search ..... 221/309, 306, 221/283, 186, 194; 312/35, 42, 49, 45, 290, 245, 138.1, 139.2, 211, 306, 312; 49/372, 373; 220/475, 345.1–345.4, 908; 232/43.5, 43.1

(56) References Cited

U.S. PATENT DOCUMENTS 348,164 * 8/1886 Judson ..... 312/45
1,511,613 * 10/1924 Joern ..... 232/43.1
2,248,633 * 7/1941 Lee ..... 312/290 X
2,602,584 * 7/1952 Croft, Jr. ..... 232/43.1
4,781,307 * 11/1988 Perro ..... 221/283 X
5,096,115 * 3/1992 Hassan ..... 232/43.1 X
5,147,119 * 9/1992 Harris ..... 312/49
5,169,218 * 12/1992 Chu ..... 312/306 X
5,232,101 8/1993 Shaftner et al. .
5,533,646 * 7/1996 Dildine ..... 221/283 X
5,667,082 * 9/1997 Hamilton et al. ..... 312/49 X
5,894,951 * 4/1999 Hunt ..... 220/475
5,998,433 11/1999 Crum .

* cited by examiner

*Primary Examiner*—Peter M. Cuomo
*Assistant Examiner*—Hanh V. Tran
(74) *Attorney, Agent, or Firm*—Thomas, Kayden, Horstemeyer & Risley LLP

(57) ABSTRACT

A ball storage apparatus is provided for storing a sport ball. The ball storage apparatus includes a ball container defined by a wall and having an upper portion and a lower portion. The ball container is arranged and configured to accommodate the ball to be stored in the apparatus. A mouth, arranged and configured for a ball of the type to be stored in the ball storage to pass therethrough, is disposed toward the upper portion of the ball container. An opening, arranged and configured for the ball of the type to be stored in the ball keeper to pass therethrough, is disposed in the wall and toward the lower portion of the ball container.

22 Claims, 4 Drawing Sheets

SPORT BALL STORAGE APPARATUS AND METHOD FOR STORING AND DISPENSING A SPORT BALL

CLAIM OF PRIORITY

This application claims priority to and the benefit of copending U.S. provisional patent application entitled "Basketball Keeper", filed on Jun. 23, 1998 and accorded Ser. No. 60/090,286, and is herein incorporated by reference.

FIELD OF THE INVENTION

The present invention generally relates to a container and a method for storing, keeping and dispensing items. More specifically, the invention is a container for storing, keeping and dispensing balls used for playing games or sports.

BACKGROUND OF THE INVENTION

Storage of balls for playing sports, such as basketballs, has been a long existing problem. Since exposure to direct sunlight can damage most sport balls and the sharp teeth and claws of an animal can puncture these balls, it is preferable to store sport balls, such as basketballs, off of the ground and out of direct sunlight to improve their life span. Additionally, keeping these balls neatly put away where they can be readily located and retrieved when one wishes to use them is generally desirable for convenience. It is therefore desirable to store such balls in an easily accessible enclosed container that is supported in a position raised off of the ground.

Several containers are known which provide a suitable stand for supporting a container for holding contents of various sorts where the container includes a lid covering an opening providing access to the interior of the container. Generally known are raised supported containers having a lid for storing garbage for both improved appearance and keeping animals out of the contents, such known containers include a container supported such as to allow the container to be tilted for emptying the contents without removing the container from the support. These known containers are configured having one opening for both placing the contents inside the container and removing the contents from the container. Such a configuration necessitates either removing the container from its support or tipping the container to remove the contents, both of which can be cumbersome and difficult.

However, none of the known containers provide for easy storage and dispensing of sport balls while keeping them supported off of the ground and out of direct sunlight. Thus, a heretofore unaddressed need exists in the industry to address the aforementioned deficiencies and inadequacies.

SUMMARY OF THE INVENTION

The present invention is a ball storage apparatus for storing a sport ball. The ball storage apparatus includes a ball container defined by a wall and having an upper portion and a lower portion. The ball container is arranged and configured to accommodate a ball to be stored therein. A mouth, arranged and configured for a ball of the type to be stored in the ball keeper to pass therethrough, is disposed toward the upper portion of the ball container. An opening, arranged and configured for the ball of the type to be stored in the ball keeper to pass therethrough, is disposed through the wall and toward the lower portion of the ball container.

The present invention is also a method for storing and dispensing a sport ball, such as a basketball. The method comprises the steps of providing a support structure and providing a ball container, where the ball container is defined by a wall having an upper portion and a lower portion. The method further comprises fixing the ball container to the support structure and providing a mouth disposed toward the upper portion of the ball container. A lid hingedly fixed to the ball container is preferably provided, where the lid can cover the mouth when disposed in a closed position and provide unobstructed access to the interior of the container through the mouth when the lid is disposed in an open position. The method further comprises providing an opening disposed through the wall of the ball container, toward the lower portion of the ball container, and providing a door slidably connected to the ball container, where the door is disposed such as to cover the opening when the door is in a closed position and to provide access to the interior of the container through the opening when the door is in an open position.

Other features and advantages of the present invention will become apparent to one with skill in the art upon examination of the following drawings and detailed description. It is intended that all such additional features and advantages be included herein within the scope of the present invention.

BRIEF DESCRIPTION OF THE SEVERAL VIEWS OF THE DRAWINGS

The invention can be better understood with reference to these drawings. While the invention is susceptible to various modifications and alternative forms, a specific embodiment thereof is shown by way of example in the drawings and will herein be described in detail. It should be understood, however, that there is no intent to limit the invention to the particular form disclosed, but on the contrary, the invention is to cover all modification, equivalents, and alternatives falling within the spirit and scope of the invention as defined by the claims. Furthermore, the components in the drawings are not necessarily to scale, emphasis instead being placed upon clearly illustrating the principles of the present invention. Finally, in the drawings, like reference numerals designate corresponding parts throughout the several views.

DETAILED DESCRIPTION OF THE INVENTION

Figure 1:
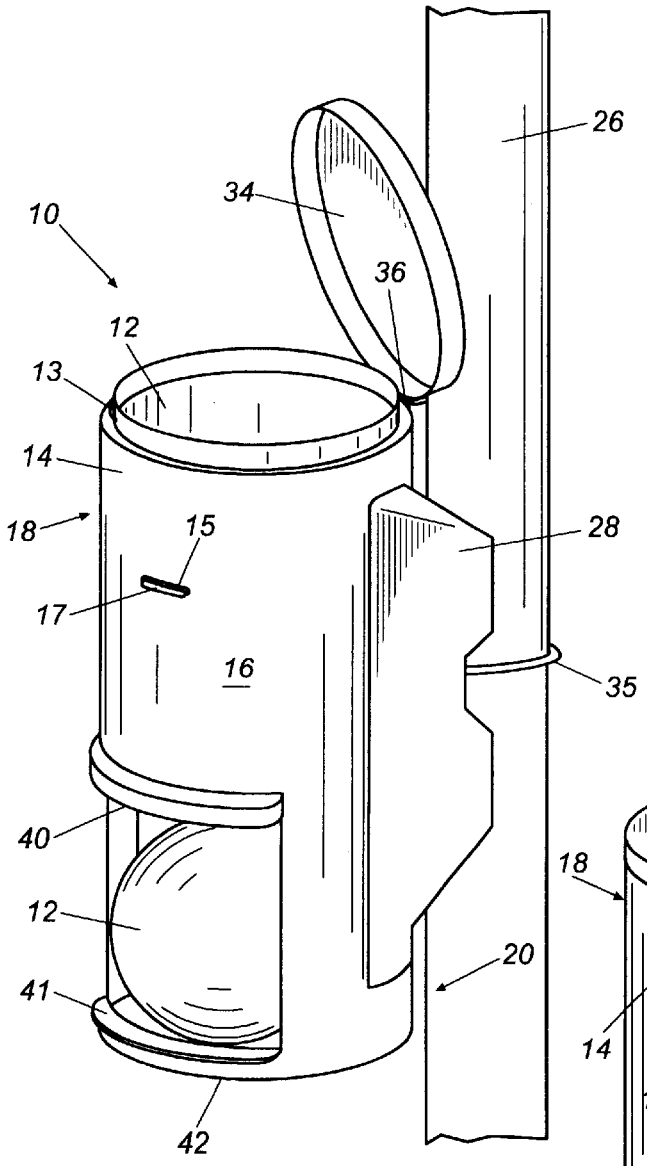
FIG. 1 is a perspective view of a first embodiment of the ball keeper apparatus of the present invention.
Figure 2:
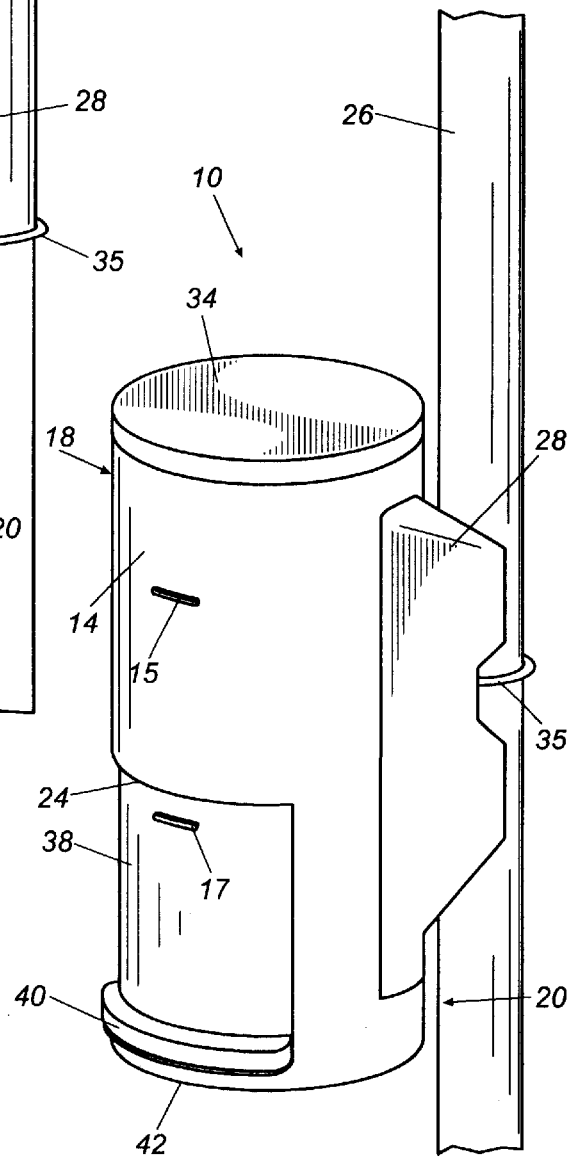
FIG. 2 is a perspective view of the ball keeper apparatus of FIG. 1.

Referring first to both FIGS. 1 and 2, shown is a first embodiment of a ball storage apparatus of the present invention referred to generally with the reference numeral 10. The ball storage apparatus 10 comprises a preferred ball container 14 defined by a wall 16 and having an upper portion 18 and a lower portion 20. The ball container 14 is preferably cylindrical in shape and sized to a diameter slightly larger than the diameter of a ball 12 desired to be stored inside the container 14. It is preferred that the container 14 comprises a high density polyethylene material, or any suitable material, and is preferably manufactured to the desired configuration through blow molding, or by any such suitable process. The container 14 preferably includes a mouth 22 disposed toward the upper portion 18 of the container 14, and an opening 24 disposed through the wall 16 and toward the lower portion 20.

The mouth 22 is preferably disposed such that the top of the upper portion 18 of the preferred cylindrical ball container 14 is fully open. It is further preferred that a lid 34 is hingedly fixed 36 to the ball container 14. The lid 34 can also be fixed to the ball container 14 with a strap (not shown) or not tethered to the container 14 at all. The preferred lid 34 is movable between an open position (FIG. 1) and a closed position (FIG. 2) and is arranged and configured to fully cover the mouth 22 when the lid 34 is disposed in the closed position (FIG. 2), and to provide unobstructed access to the full diameter of the mouth 22 when the lid 34 is disposed in the open position (FIG. 1). An edge portion of the mouth 12 can include a lock 13 extending therefrom. The lock 13 is preferably arranged and configured to engage a portion of the lid 34 when the lid 34 is disposed in the closed position. The lock 13 preferably aids in maintaining the lid 34 in the closed position. It is preferred that the ball 12 desired to be stored in the apparatus 10 is placed for storage in the apparatus 10 through the mouth 22 when the lid 34 is in the open position. It should be noted that the ball 12 can be removed from the apparatus 10 through the mouth 22, as well. With the ball 12 placed inside the container 14, the lid 34 can be disposed in the closed position (FIG. 2) to protect a stored ball 12 from wear imposed by weather. The lid 34 can also be disposed in the closed position enclosing an empty ball container 14 to keep foreign objects out and the interior of the container 14 clean. The lid 34 can comprise high density polyethylene material formed in a blow molding process or any such suitable material formed in any suitable process.

An opening 24 is preferably disposed through the wall 16 of the ball container 14 and toward the lower portion 20 of the container 14. The opening 24 is preferably arranged and configured to accommodate one ball 12 to pass therethrough and is disposed just above a base portion 42 of the container 14. The opening 24 can preferably be used to remove the ball 12 from the apparatus 10 when storage of the ball 12 is no longer desired. It is further preferred that the apparatus 10 comprises a door 38 that substantially corresponds to the opening 24.

The preferred door 38 is preferably slidably fixed to the wall 16 of the ball container 14 toward the lower portion 20 and adjacent the opening 24. The door 38 is preferably slidably movable between an open position (FIG. 1) and a closed position (FIG. 2). It is preferred that the open position (FIG. 1) provides unobstructed access to the interior of the container 14 through the full dimension of the opening 24, thereby facilitating easy removal of the ball 12 that is stored in the container 14. The wall 16 can include an aperture 15 disposed therethrough for engaging a tab 17 disposed on the door 38 to maintain the door 38 in the open position when the door 38 is raised. It should be noted, however, that the ball 12 can also be placed into the container 14 though the opening 24. When disposed in the closed position the door 38 prevents access to the interior of the container 14 through the opening 24. The opening 24 can include a closure lip 41 extending from a portion of the wall 16 toward the bottom of the opening 24. The closure lip 41 is preferably arranged and configured to aid in keeping the door 38 in the closed position. As such, the ball 12 being stored therein cannot be removed and will not inadvertently fall out. It is further preferable that the door 38 includes a handle 40 disposed toward the lower end thereof and extending outwardly, away from the door 38, to facilitate easy movement of the door 38 between the open position and the closed position.

In one embodiment of the ball storage apparatus 10, the base portion 42 of the ball container 14 can be slightly angled downward toward the opening 24. In this configuration, the angled base portion 42 aids to urge the stored ball 12 out of the opening 24 for removal from the container 14 when the door 38 is moved to in the open position.

Figure 3:
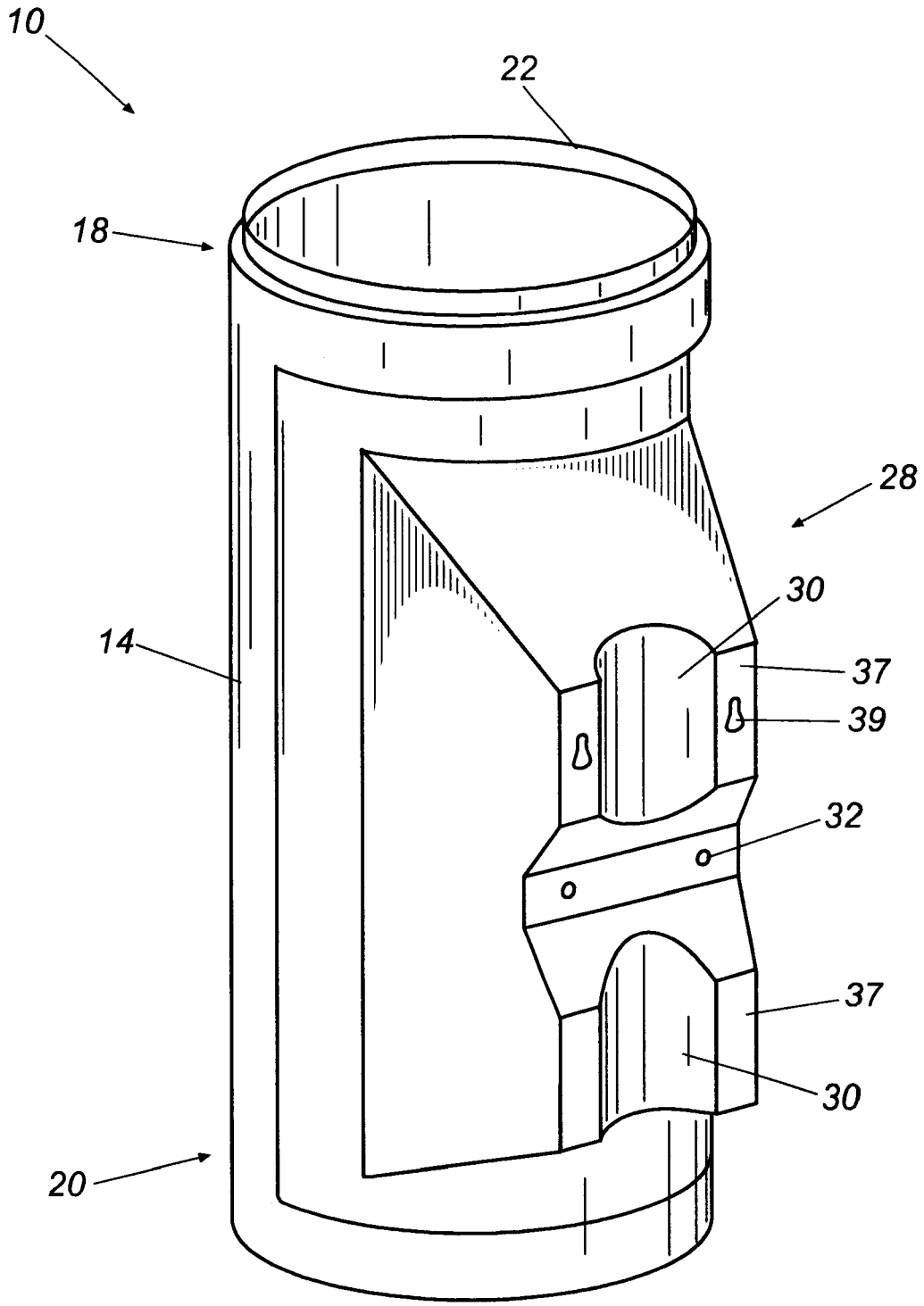
FIG. 3 is a perspective view of the ball keeper apparatus of FIG. 1 where the support mount is shown.

Turning next to FIG. 3, a first embodiment of a preferred support mount 28 is illustrated. It is preferable that the support mount 28 extends from the wall 16 of the ball container 14 and is formed as a molded portion of the ball container 14. It should be noted, however, that the support mount 28 can be a separate member fixed to the container 14 in an assembly process. The support mount 28 is preferably arranged and configured to accommodate mounting the apparatus 10 on surfaces of various configurations. The preferred support mount 28, illustrated in FIG. 3, includes a pair of concave portions 30 extending from the ball container 14. The concave portions 30 are preferably arranged and configured to correspond to and receive a substantially cylindrical support structure 29, such as a standard basketball goal support pole. It should be noted that although two concave portions 30 are disclosed herein, any number of concave portions 30 can be included. The support mount 28 preferably further includes a pair of first fixing apertures 32 for receiving a fixing member 35, such as a U-bolt, for fixing the apparatus 10 to a substantially cylindrical support structure 24. It should be noted that any suitable fixing member 35 can be used and that the first fixing apertures 32 can be arranged and configured to accommodate any such suitable fixing member 35. The support mount 28 can further include a substantially planar mount surface 37 to accommodate mounting the apparatus 10 on a substantially planar surface 27 (FIG. 5), such as a wall. It is further preferred that the planar mount surface 37 include a second fixing aperture 39 for fixing the apparatus 10 to a substantially planar surface 27 (FIG. 5) by placing fixing member 35 in fixing aperture 39. Although one pair of second fixing apertures 39 is illustrated, it should be understood that additional fixing apertures 39 may be included. Similarly, although two pairs of mount surfaces 37 are disclosed herein, any suitable number of planar mount surfaces 37 can be included in the support mount 28.

Figure 4:
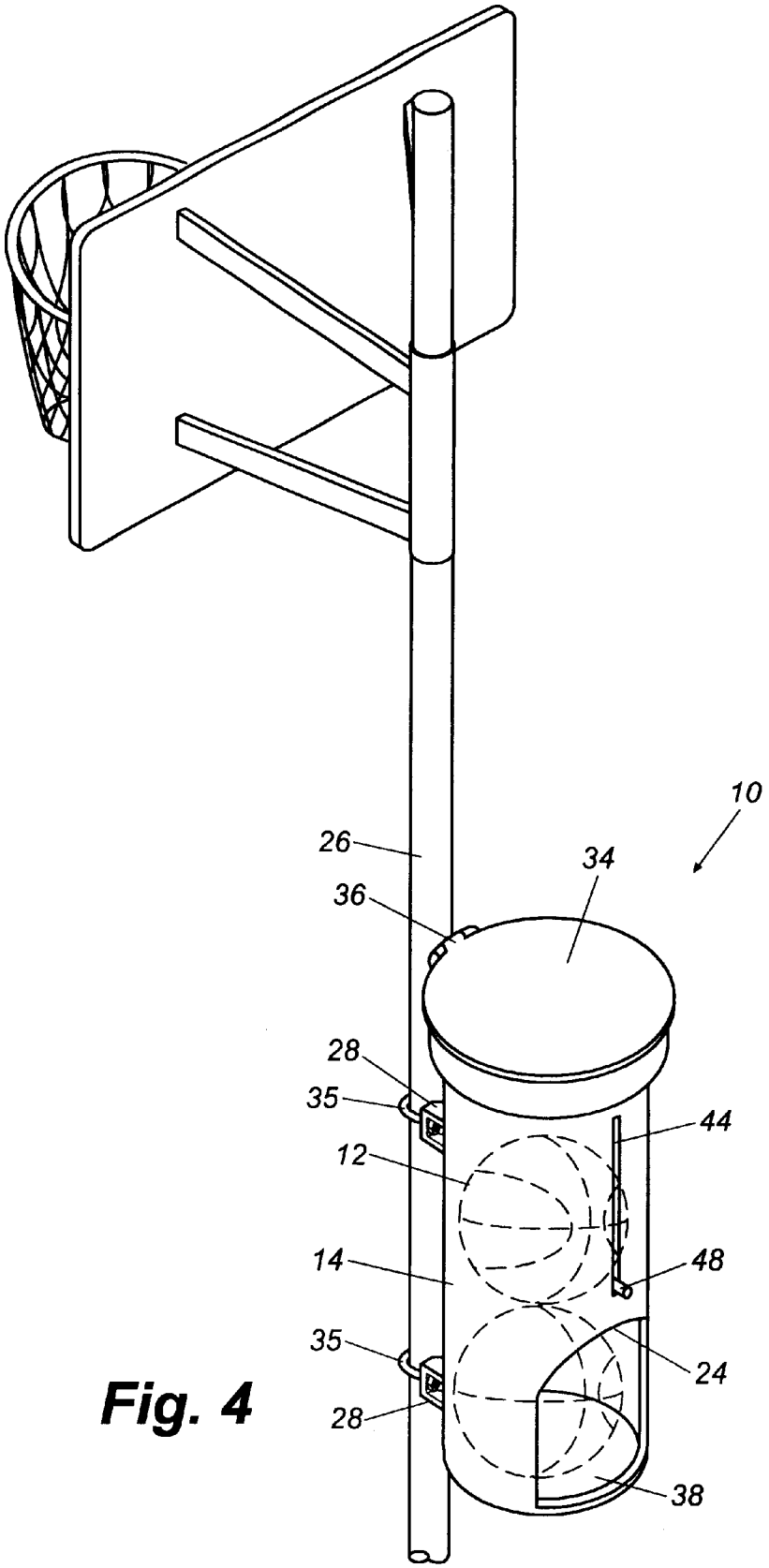
FIG. 4 is a perspective view of a second embodiment of the ball keeper apparatus of the present invention.

Referring to FIG. 4, a second embodiment of the ball storage apparatus 10 is shown. The ball storage apparatus 10 of the second embodiment comprises a ball container 14 having a mouth and an opening 24 arranged and configured substantially similarly to the first embodiment. A door 38, arranged and configured to correspond to the opening 24, preferably comprises a lever 48 extending therefrom. The ball container 14 of the second embodiment preferably comprises a slot 44 disposed through the wall 16 of the container 14. The slot 44 is arranged and configured to accommodate the lever 48 passing therethrough. The lever 48 can preferably be used to move the door 38 between an open position and a closed position. The second embodiment of the apparatus 10 further comprises a pair of supports 36 extending from the container 14. Each support 36 is preferably arranged and configured to accommodate a support structure 26, such as a support post for a basketball goal, and a fixing member 35 for fixing the apparatus 10 to the support member 26.

Figure 5:
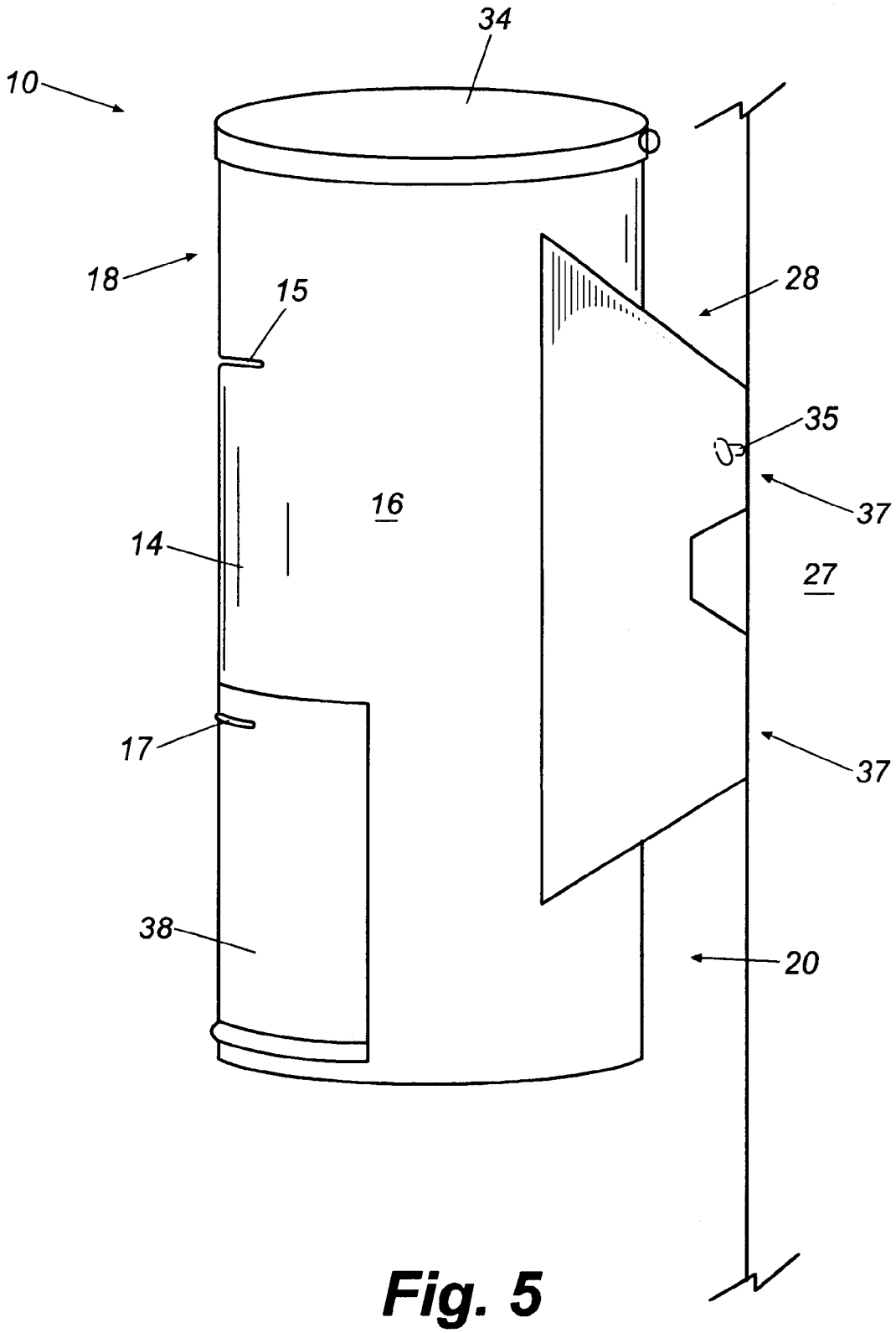
FIG. 5 is a side view of the ball keeper apparatus of FIG. 1, where the apparatus is mounted on a substantially planar surface.

In a preferred method for ball storage, a support structure 26 is provided. The support structure 26 provided is preferably a basketball goal support pole, however, the support structure 26 provided can comprise any configuration, including a substantially planar surface 27, such as a wall. Further provided is a ball container 14 preferably being defined by a wall 16 in a substantially cylindrical arrangement and having an upper portion 18 and a lower portion 20. It is preferable to further provide a mouth 22 toward the upper portion 18 of the container 14 and an opening 24 through the wall 16 of the container 14 and toward the lower portion 20 of the container 14. It is preferable that both the mouth 14 and the opening 24 are configured to accommodate a sport ball 12 of the type to be stored in the container 14. In the preferred storage method a lid 34 is provided, for covering the mouth 22, as well as a door 38, for covering the opening 24. For storage of the ball 12, the container 14 is preferably fixed to the support structure 26, and a support mount 28 is provided to facilitate fixing the container 14 to the support structure 26. A preferred support mount 28 can be arranged and configured to interchangeably accommodate support structures 26 of various configurations, such as a pole or a substantially planar surface 27 (FIG. 5). When placing a ball 12 in the container 14, the door 38 is preferably disposed in a closed position while the lid 34 is disposed in an open position. The ball 12 can then be placed through the mouth 22 and into the container 14. It is then preferable that the lid 34 is disposed in a closed position (FIG. 2) for storing the ball 12. To remove the ball 12 from the container 14, the door 38 is preferably moved from the closed position, preferred for storage, to the open position and the ball 12 removed from the container 14 through the opening 24. The door 38 can be disposed between the open position and the closed position either by grasping the handle 40, of the first embodiment, or the lever 48, of the second embodiment. The lid 34 and the door 38 can then be either disposed in the open position or the closed position after the ball 12 is dispensed from the container 14.

Many variations and modifications may be made to the above-described embodiment(s) of the invention without departing substantially from the spirit and principles of the invention. All such modifications and variations are intended to be included herein within the scope of the present invention.

Therefore, having thus described the invention, at least the following is claimed:

1. A ball storage apparatus for storing a sport ball, said ball storage apparatus comprising:

a ball container, said ball container being defined by a wall and having an upper portion and a lower portion, said wall being arranged and configured to substantially correspond to a circumference of a sport ball of the type to be stored in said storage apparatus;

a support mount extending outward from said wall of said ball container, said support mount having a mounting surface comprising at least one planar mount surface to mount said apparatus on a substantially planar surface and at least one concave portion to mount said apparatus on a substantially arcuate surface;

a mouth for receiving a sport ball of the type to be stored in said ball storage apparatus, said mouth being disposed toward said upper portion of said ball container, said mouth arranged and configured to substantially correspond to a sport ball of the type to be stored in said ball storage apparatus;

a substantially vertical opening, said opening being disposed in said wall and toward said lower portion of said ball container, said opening being arranged and configured for the ball of the type to be stored in said ball storage apparatus to pass therethrough; and wherein said ball container is arranged and configured to accommodate the ball to be stored in said apparatus.

2. The ball storage apparatus of claim 1, further comprising a support structure, wherein said support structure supports said apparatus.

3. The ball storage apparatus of claim 2, wherein said support structure comprises a pole, said concave portion of said support mount receiving said pole, said support mount being arranged and configured to accommodate a fixing member for fixing said apparatus to said pole.

4. The ball storage apparatus of claim 3, wherein said pole comprises a basketball goal support.

5. The ball storage apparatus of claim 2, wherein said support structure comprises a planar surface, said planar portion of said support mount being substantially flush with said support structure, said support mount being arranged and configured to accommodate a fixing member for fixing said apparatus to said planar surface.

6. The ball storage apparatus of claim 1, further comprising:

a lid, said lid being hingedly fixed to said ball container and movable between an open position and a closed position, wherein said lid being arranged and configured to cover said mouth when said lid is disposed in said closed position and to provide access to said mouth when said lid is disposed in said open position.

7. The ball storage apparatus of claim 1, further comprising:

a door, said door being slidably fixed to said wall of said ball container and movable between an open position and a closed position and disposed such as to cover said opening when said door is disposed in a closed position and to provide access to said opening when said door is disposed in said open position.

8. The ball storage apparatus of claim 7, further comprising:

a handle, said handle being disposed on said door to facilitate sliding said door.

9. The ball storage apparatus of claim 7, further comprising:

a lever, said lever being disposed on said door; and a slot, said slot being disposed through said wall of said container and being oriented to extend longitudinally from said upper portion toward said lower portion;

wherein said slot being arranged and configured to receive said lever therethrough.

10. The ball storage apparatus of claim 7, further comprising:

a base portion disposed toward said lower portion of said ball container, wherein said base portion comprises a downward slant toward said opening such as to urge said ball out of said opening when said door is in said open position.

11. The ball storage apparatus of claim 7, further comprising:

a lock extending from said wall toward said upper portion and adjacent said mouth;

wherein said lock is arranged and configured to engage a portion of said lid when said lid is disposed in said closed position.

12. The ball storage apparatus of claim 7, further comprising:

an aperture disposed through said wall;

a tab disposed on said door;

wherein said aperture is arranged and configured to engage said tab disposed on said door when said door is disposed in said open position.

13. A ball storage apparatus for storing a sport ball, said ball storage apparatus comprising:

a mounting means for mounting said ball storage apparatus, said mounting means extending outward from a wall of said ball container, said mounting means having a mounting surface comprising at least one planar mount surface to mount said apparatus on a substantially planar surface and at least one concave portion to mount said apparatus on a substantially arcuate surface;

a containing means for containing said ball, said containing means being defined by said wall and having an upper portion and a lower portion, said wall being arranged and configured to substantially correspond to a circumference of a sport ball of the type to be stored in said ball storage apparatus, said containing means being mounted on said support means;

a loading means for receiving a sport ball of the type to be stored in said ball storage apparatus, said loading means being disposed toward said upper portion of said containing means, said loading means arranged and configured to substantially correspond to a sport ball of the type to be stored in said storage apparatus;

a dispensing means, said dispensing means being disposed in said wall of said containing means and toward said lower portion of said containing means, said dispensing means being arranged and configured for said ball pass therethrough; and a cover means for cohering said loading means, said cover means being hingedly fixed to said containing means.

14. The ball storage apparatus of claim 13, wherein said mounting means further comprises:

a fixing means for fixing said containing means to a supporting means for supporting said apparatus.

15. The ball storage apparatus of claim 13, further comprising:

a dispensing cover means, said dispensing cover means being slidably fixed to said wall of said container means, said dispensing cover means being arranged and configured to cover said dispensing means when disposed in a closed position and to dispense said ball from said containing means when said dispensing cover means is in an open position.

16. A method for storing and dispensing a sport ball, said method comprising the steps of:

providing a support structure;

providing a ball container, said ball container being defined by a wall, said ball container having an upper portion and a lower portion and said wall being arranged and configured to substantially correspond to a sport ball being stored therein, so that motion in a plane perpendicular to the longitudinal axis of said ball container is minimal yet the sport ball moves freely along the longitudinal axis of said ball container;

providing a support mount extending outward from said wall of said ball container, said support mount comprising at least one planar mount surface for mounting said apparatus on a substantially planar support surface and at least one concave portion for mounting said apparatus on a substantially arcuate support surface;

fixing said ball container to said support structure;

providing a mouth disposed toward said upper portion of said ball container, said mouth being arranged and configured to accommodate the sport ball;

providing a lid disposed over said mouth, said lid being hingedly fixed to said ball container;

providing an opening disposed in said wall of said ball container and toward said lower portion of said ball container, said ball container being arranged and configured to accommodate a game ball passing therethrough; and providing a door, said door being slidably connected to said ball container, said door being disposed such as to cover said opening when said door is in a closed position and to provide access through said opening when said door is in an open position.

17. The method of claim 16, further comprising the steps of:

providing said door in said closed position;

providing said lid in said open position;

placing the ball in said ball container through said mouth of said ball container; and disposing said lid in said closed position.

18. The method of claim 16, further comprising the steps of:

providing said door in said open position; and removing said ball from said ball container through said opening.

19. The method of claim 16, further comprising the step of:

providing a base portion toward said lower portion of said ball container;

wherein said base portion comprises a downward slant toward said opening such as to urge said ball out of said opening when said door is in said open position.

20. The method of claim 16, further comprising the step of:

providing a closure lip extending from said wall toward said lower portion and adjacent said opening;

wherein said closure lip is arranged and configured to engage a portion of said door when said door is disposed in said closed position.

21. The method of claim 16, further comprising the step of:

providing an aperture disposed through said wall;

providing a tab disposed on said door;

wherein said aperture is arranged and configured to engage said tab disposed on said door when said door is disposed in said open position.

22. A basketball storage arrangement for storing a basketball and protecting said basketball from weathering, said arrangement comprising:

a basketball goal support structure, said basketball support structure supporting a basketball goal;

a basketball container, said basketball container comprising a cylindrical member having a top portion and a lower portion and a wall, said wall being arranged and configured to substantially correspond to a circumference of a sport ball of the type to be stored in said ball storage apparatus;

a support mount, said support mount extending outwardly from said basketball container, said support mount comprising at least one planar mount surface for mounting said apparatus on said support structure being substantially planar and at least one concave portion for mounting said apparatus on a support structure being substantially arcuate;

a mouth, said mouth being disposed in said top portion of said basketball container, said mouth being arranged and configured to allow a basketball to pass therethrough;

a substantially vertical opening, said opening being disposed in said wall toward said lower portion of said basketball container, said opening being arranged and configured to allow a basketball to pass therethrough;

a lid, said lid being hingedly fixed to said basketball container, said lid being disposed adjacent said mouth; and a door, said door being slidably fixed to said wall, said door covering said opening when disposed in a first position and said door uncovering said opening when disposed in a second position;

wherein said basketball container comprises a diameter slightly greater than a diameter of a basketball.

* * * * *